United States Patent [19]

Hanse et al.

[11] Patent Number: 5,016,788

[45] Date of Patent: May 21, 1991

[54] POURING SPOUT FOR SERVO-ASSISTED OPENING, DEVICE INCORPORATING IT AND IMPLEMENTATION PROCESS

[75] Inventors: Eric Hanse, Elouges, Belgium; Gilbert Rancoulle, Bedford, Mass.

[73] Assignee: Vesuvius Crucible Company, Pittsburgh, Pa.

[21] Appl. No.: 314,906

[22] Filed: Feb. 24, 1989

[30] Foreign Application Priority Data

Feb. 26, 1988 [FR] France ..... 88 02407

[51] Int. Cl.[5] ..... B22D 41/58

[52] U.S. Cl. ..... 222/590; 222/603; 266/220

[58] Field of Search ..... 222/590, 592, 603; 266/220, 236, 265, 270

[56] References Cited

U.S. PATENT DOCUMENTS

| | | | |
|---|---|---|---|
| 3,651,825 | 3/1972 | Sury | 266/236 |
| 3,838,390 | 10/1974 | Voss | 222/148 |
| 4,203,538 | 5/1980 | Luhrsen | 222/603 |
| 4,421,257 | 12/1983 | Thrower | 222/603 |
| 4,756,452 | 7/1988 | Tsukamoto et al. | 222/603 |
| 4,836,508 | 6/1989 | Fishler | 222/603 |

FOREIGN PATENT DOCUMENTS

| | | |
|---|---|---|
| 0059805 | 11/1981 | European Pat. Off. . |
| 1368390 | 12/1972 | United Kingdom . |

*Primary Examiner*—S. Kastler

*Attorney, Agent, or Firm*—Webb, Burden, Ziesenheim & Webb

[57] ABSTRACT

The invention concerns a casting spout for assisted opening. It is comprised of an upper part at least partially permeable to gas and a means for bringing a gas to the said upper part. Application to transport for continuous casting feed.

8 Claims, 3 Drawing Sheets

Figure 1B:
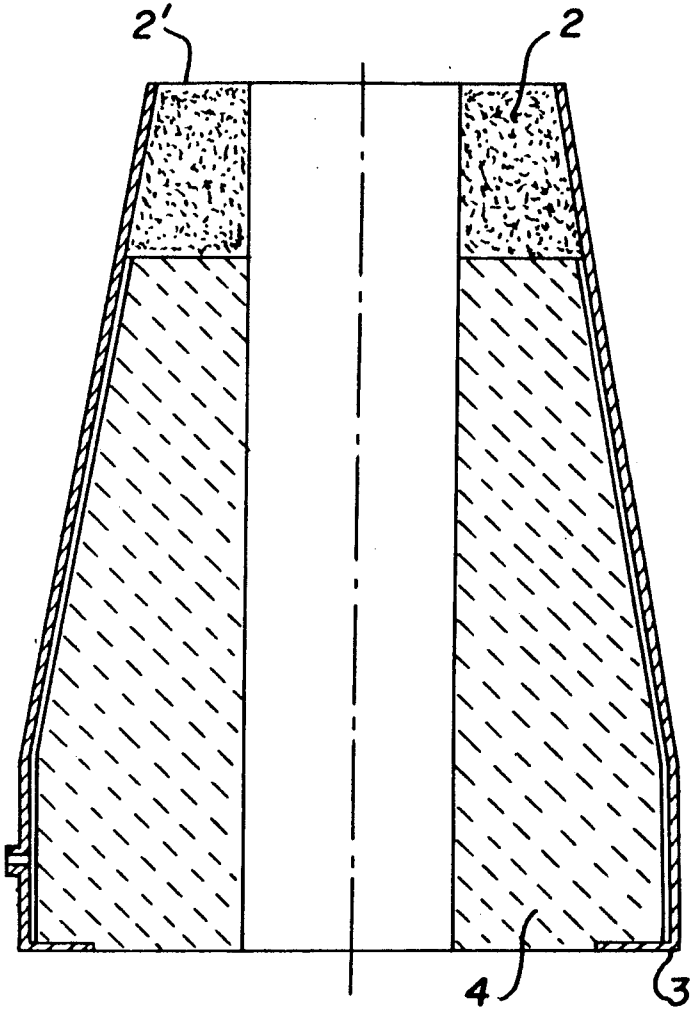

POURING SPOUT FOR SERVO-ASSISTED OPENING, DEVICE INCORPORATING IT AND IMPLEMENTATION PROCESS

The present invention concerns a pouring spout with assisted opening; it also concerns the pouring ladles equipped with such a spout and the mode of utilization of such a spout.

In the pyrometallurgical industry the molten metal is transported either for metallurgical treatment, as in continuous casting, or to bring it to refining operations, or for any other reason by means of receptacles called ladles. The transfer of the molten metal from the ladle to the tool where the metal is to be treated, either by dumping, or by means of casting holes, most frequently equipped with spouts or nozzles. The opening of the tapholes is a general problem, frequently difficult to resolve, especially when the metal is a metal or alloy with a high melting point, such as iron or the various steels whose melting point is close to that of iron.

The problem is even more acute when the operation conducted on the molten metal is an operation of physical metallurgy, i.e., in which it is no longer possible to make additions to restore the metal or alloy to the desired grade.

In effect, when the taphole is opened, it is often necessary to use the oxygen lance technique, which makes it possible to melt the surface crust by means of the heat given off by combustion of the lance in contact with oxygen. This oxygen injection can modify the composition of the alloy or metal; it is particularly troublesome in the case of steel destined for continuous casting.

The above problem is particularly significant in the case of ladles used for continuous casting systems in the iron and steel industry. The invention to be expounded is also directed in particular toward resolving this problem. It is for this reason that no further reference will be made in the following to the problem of continuous casting ladles in ferrous metallurgy. This application will serve as a model for all the other applications.

According to the technique most generally used, the continuous casting ladles are equipped with a spout placed at the bottom of the ladle and maintained by a refractory system. This spout has a cylindrical opening in its center through which the molten metal flows. The closure system of this opening is generally of the slide valve type.

During operation, the slide valve being closed, the opening of the spout is filled with a sand generally formed of refractory material and this sand is allowed to overflow into the upper part of the spout and on the bottom of the ladle near the casting orifice. The steel is then poured into the ladle and a crust of variable thickness forms at the bottom of the casting ladle, notably above the layer of sand of the spout. When the ladle is to be emptied, the taphole of the spout is opened, the sand runs out and the hydrostatic pressure of the steel in the ladle is sufficient to break the crust and induce the flow. However, this is true only in theory and there are numerous cases where the crust is too solid to be broken by the said hydrostatic pressure.

It is then necessary to unstop it as explained above, by means of oxygen lances, with the risk of losing the production of the corresponding continuous casting.

This is why one of the purposes of the present invention is to offer a spout that makes it possible to avoid the inopportune blockage of the spout and the resulting inconvenience, whether at the level of the steel grade with a possible downgrading of the latter and the loss of time and productivity of the overall installation.

Another purpose of the present invention is to furnish an assisted-opening system for implementing the spout of the above type.

Finally, another purpose of the present invention is to furnish an assisted-opening process employing the above spout.

These goals and others that will be manifested in the following are achieved by means of the casting spout of the type used for the ladles for the transport of metal for assisted opening, characterized in that it is comprised of an upper part and a lower part, the said upper part being at least partially permeable to gas, and a means of bringing a gas to the said upper part.

Thus, according to the present invention, it was demonstrated that it was possible to break the crust formed during the transport of the steel by injecting a gas that is inert relative to the metal at a pressure definitely superior to that of the hydrostatic pressure of the molten metal.

One of the roles of the spout according to the present invention is to permit the gas to arrive in the vicinity of the sand and metal crust at the bottom of the ladle and thus to develop a force that is capable of breaking this crust.

Although one cannot exclude the means of bringing in the gas by a simple inlet channel for the inert gas at the upper surface of a spout, one of the preferred modes of this latter consists in a spout formed of a gas-permeable porous part, forming the upper part of the spout, while the remainder is comprised of a material impervious to gas.

The porous materials are preferably selected from the group comprised of alumina, magnesia, the alumina-chrome mixture, zirconia, zircon, silica and any refractory with a nitride carbon binder, ceramic and chemical. It is obvious that the porous material must be refractory and should be able to tolerate the temperature of the molten metal to be transported.

The actualization of this composite spout involved familiar techniques, e.g., pressure sintering.

The spout can also be made in one piece or in several pieces that are cemented together with a binder adapted to this type of refractory.

The spout can also be made of refractory elements joined together by means of a carbon ceramic or chemical binder. This is true both for the porous and solid refractory components.

The means of bringing the gas to the said upper part can be a channel of a special shape to assure a good distribution of gas feed to the porous section and to avoid insofar as possible a pressure drop during passage through this latter.

The means of bringing a gas to the upper part can also be a jacket surrounding the spout or also piping.

The permeability of the spout can also be achieved by means of at least one channel, preferably more than one, the upper orifice of which empties at the upper surface of the said spout. Preferably, a plurality of channels or systems that form pipes is chosen.

The shape of these channels or these tubes is chosen among the group comprised of cylinders, portions of cylinders and any ordinary tubular form.

Finally, the permeability of the spout can be simultaneously assured by using a porous material and by networks of channels in its upper part.

When a porous material is selected, the mean diameter of its pores is preferably less than 100 μ, preferably 1-10μ(a significant figure). When piping is used, its diameter is preferably less than 1 mm.

It has already been proposed to use porous spouts, but in this case totally porous spouts were involved, the purpose of which was to assure the injection of a small stream of argon during casting in order to avoid the accumulation of alumina in the taphole.

In contrast to this state of the art, according to the present invention, the spout is permeable only in its upper part. It is not possible to use a completely permeable spout because such a spout favors cooling and a gain in mass in the taphole, resulting in an even worse opening than normal. This is why the lower part, preferably at least the lower half, of the spout should be of a material impermeable to gas.

Embodiments of the spout are shown in FIG. 1.

Figure 1A:
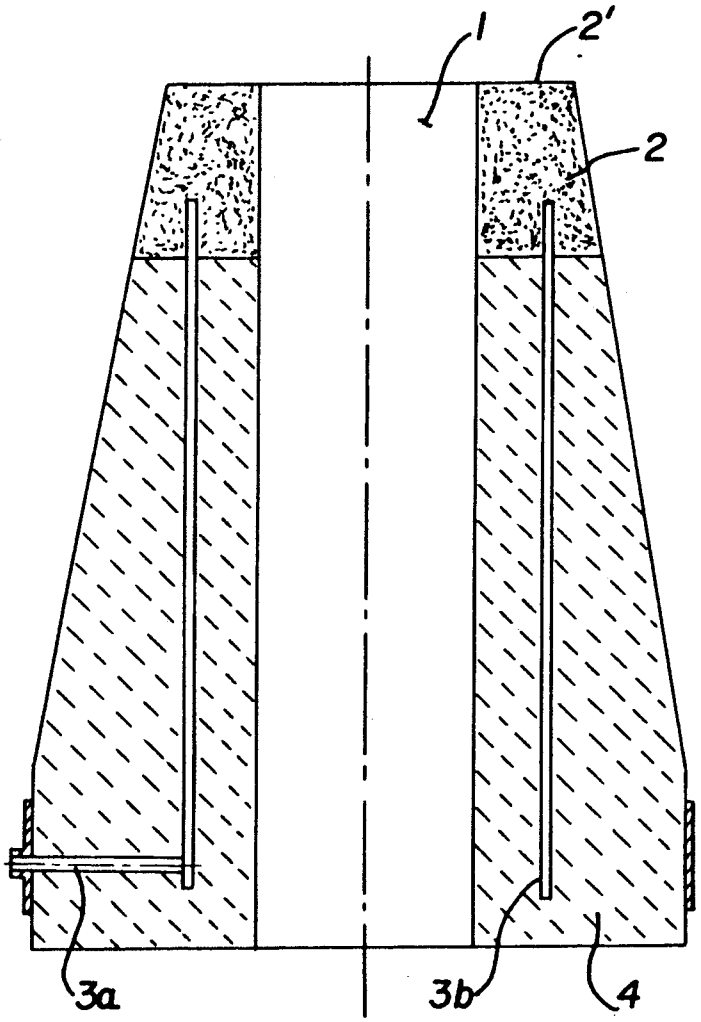

FIG. 1*a* shows a spout with an axial taphole designated as 1, a permeable part of porous material 2 and means for bringing in the gas 3*a* and 3*b*.

FIG. 1*b* shows a spout of the same type as above with the same numbers, where the means of supplying the gas 3 are comprised of a jacket surrounding the spout. The impermeable portion is designated by 4.

Figure 1D:
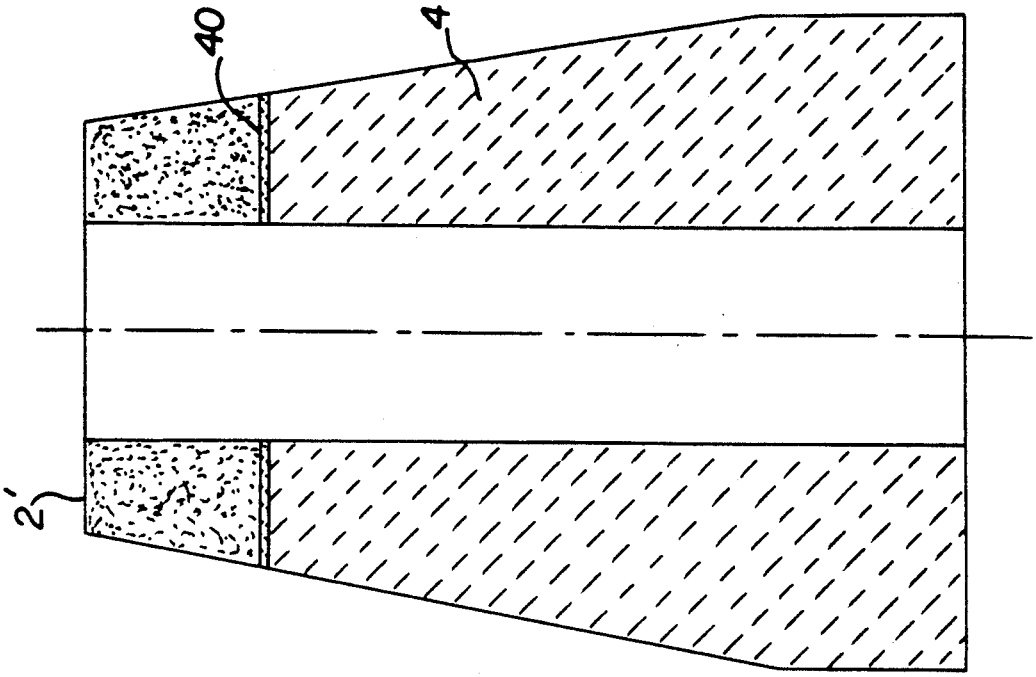
Figure 1C:
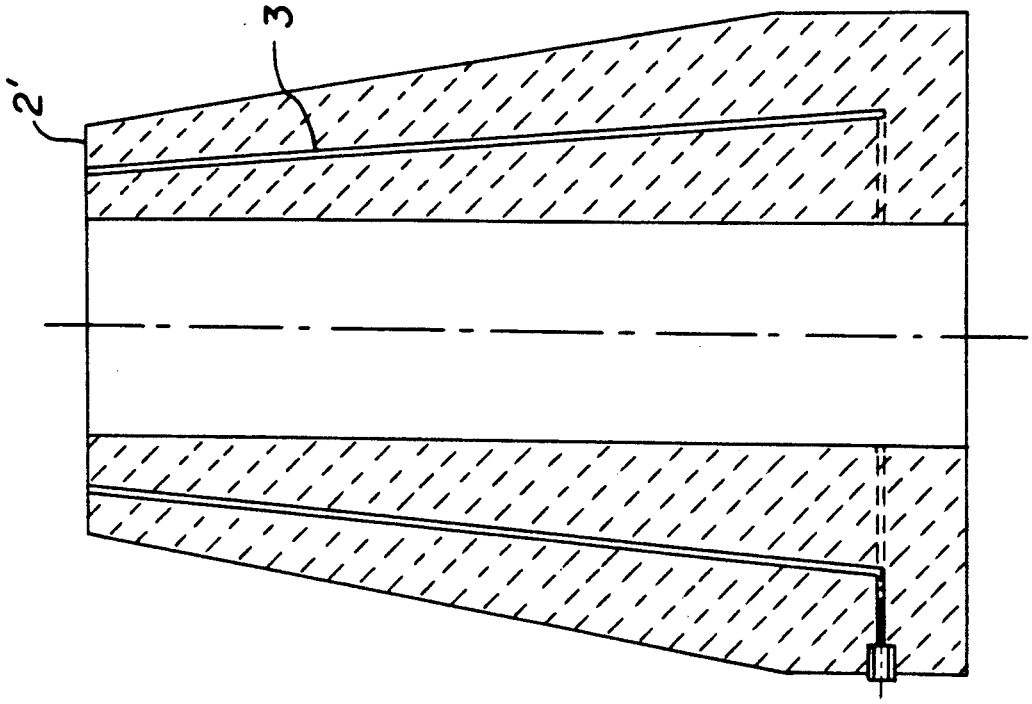

FIG. 1*c* also shows a spout according to the invention, in which there is no porous part 2, but an impermeable part rendered permeable by a gas supplying system 3 that extends up to the upper surface of the spout. These means of supplying gas are of course of refractory material.

FIG. 1*d* shows a spout in two pieces: a porous part 2 as in the preceding drawings and a non-porous part 4. The two parts are cemented together by a refractory binder 40. The means of supplying gas are not shown in this Figure.

Figure 2:
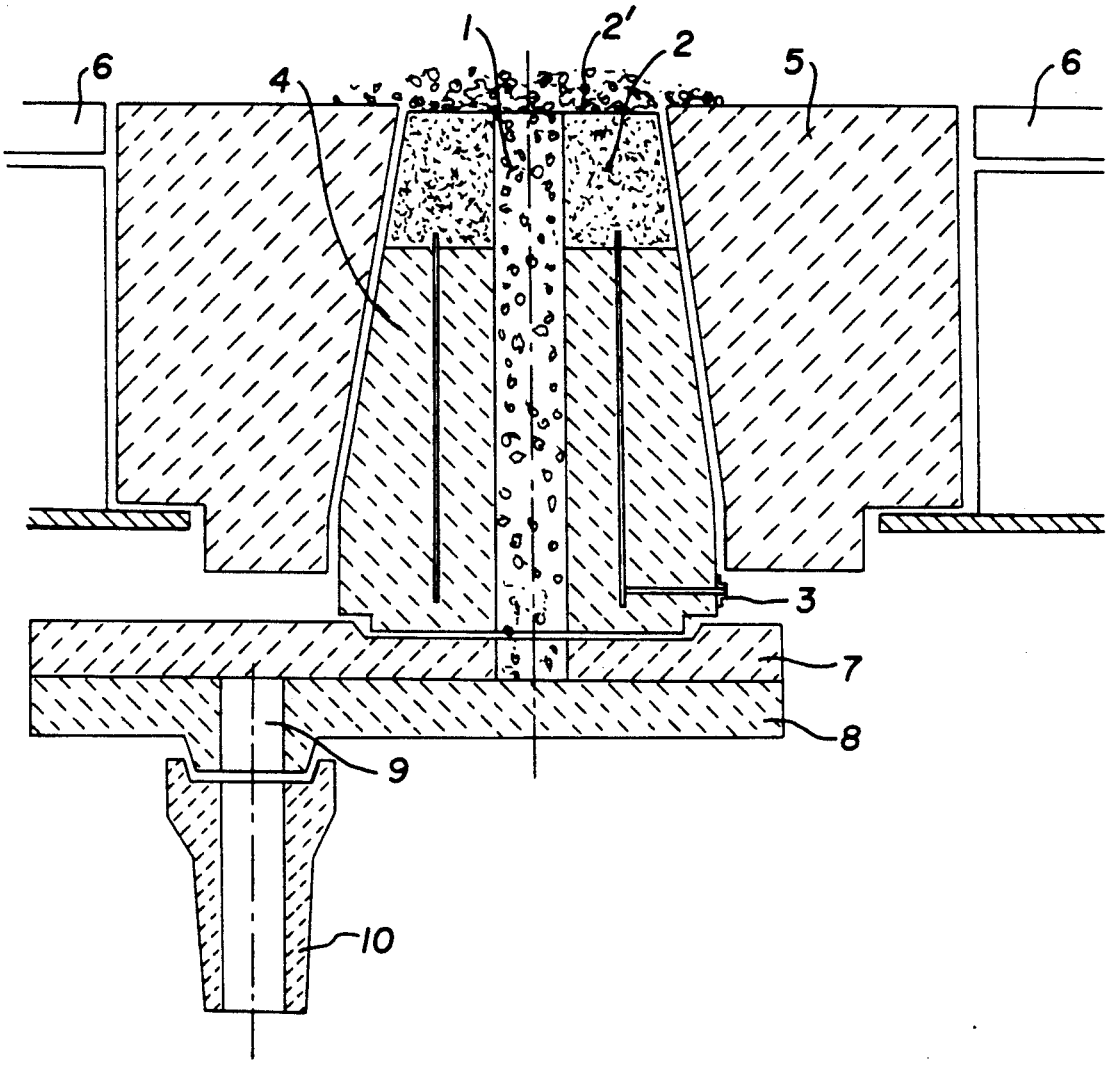

Another purpose of the present invention is a casting system with assisted opening and a ladle equipped with this system, comprised of at least one spout, a system for fastening the spout and a system of slide valves for opening the spout. Such a casting system is shown in FIG. 2.

In this Figure, the elements of the spout are designated as in the preceding drawing: bottom of the ladle 6, a conventional well block 5 fitted in the ladle bottom 6 a system of slide valves comprised of a fixed part 7 in the utilization that is described, a mobile part 8, with a taphole 9 and a piece guiding the jet 10. In this system of opening with slide valves in normal operation, the hole 9 is placed in front of the opening 1 by translation of the mobile part 8, inducing the flow of the sand filling the opening 1, then the rupture of the crust of steel and sand. In FIG. 2 it is seen that the upper gas permeable portion 2 has a flat upper surface 2' which surrounds the taphole 1 and which is substantially co-planar with the upper surface of the well block 5.

According to the invention, before bringing the hole 9 in front of the opening 1, an inert gas such as argon, the rare gases, mixtures that are non-reactive with respect to the metal to be transported is injected by the means 3 (cf. CLU technique) into the permeable part of the spout at a pressure sufficient to break the crust. It is possible to raise the pressure until a release of inert gas or a decrease in the counterpressure in the spout is detected at the surface of the molten metal bath.

This injection of an inert gas presents the advantage of agitating the metal bath near the taphole and thus reheating it, which facilitates the casting. The pressure of the inert gas is determined case by case; however, it can be noted that a pressure twice as great as the hydrostatic pressure of the metal bath is frequently necessary. In general, however, the differential pressure (with respect to the hydrostatic pressure of the metal bath) required is approximately 1-5 times the said hydrostatic pressure, or with respect to atmospheric pressure, 2-6 times the said hydrostatic pressure.

We claim:

1. A spout for placement in a well block of a bottom teeming ladle of the type used in casting molten metal, said spout comprising:

A refractory body having an axial bore therethrough for forming a taphole in said ladle bottom, said refractory body including an upper gas permeable portion and a lower gas impermeable portion, said gas permeable portion having an upper planar surface surrounding an inlet end of said taphole and said gas impermeable portion surrounding said axial bore of the taphole along a substantial portion thereof and around an outlet end thereof to prohibit the presence of a pressurized gas within a lower portion of said taphole, channel means formed in said refractory body communicating with said upper gas permeable portion at one end and adapted to be placed in communication with a source of pressurized gas, whereby in use, said pressurized gas permeates said upper gas permeable portion of the refractory body and exits at said upper planar surface thereof adapted to break a crust formed above said taphole to permit the teeming of molten metal therethrough.

2. Spout according to claim 1, wherein the upper gas permeable portion is comprised of a porous material.

3. Spout according to claim 2, wherein said porous material is chosen from the group comprised of alumina, magnesia, an alumina-chrome mixture, zirconia, zircon, silicon and any refractory with a ceramic and chemical nitride carbon binder.

4. Spout according to claim 1, wherein said upper portion has at least one channel formed therein including an upper orifice terminating on the upper planar surface of said spout, whereby said upper portion is rendered gas permeable.

5. The spout according to claims 1, 2, 3, or 4, wherein the ladle is of the type which includes a slide valve system positioned beneath said spout.

6. In combination, a ladle and spout according to claim 2.

7. A process for opening a taphole in the bottom of a ladle containing a bath of molten steel comprising:

providing a spout in a well block of said ladle, the spout comprising a refractory body having an axial bore therethrough defining said taphole in the ladle bottom, said refractory body including an upper gas permeable portion and a lower gas impermeable portion, said gas permeable portion having an upper planar surface surrounding an inlet end of said taphole and said gas impermeable portion surrounding said axial bore of the taphole along a substantial portion thereof and around an outlet end thereof to prohibit the presence of a pressurized gas within a lower portion of said taphole and around an outlet end thereof;

injecting a pressurized inert gas to said upper gas permeable portion of said spout at a pressure greater than a hydrostatic pressure of the steel bath;

emitting bubbles of said inert gas from the upper planar surface of said gas permeable portion to agitate said steel bath; and breaking a crust formed around said taphole whereby teeming of molten steel commences.

8. Process according to claim 7, wherein the pressure of the inert gas is between two and six times the hydrostatic pressure of the metal bath.

* * * * *

UNITED STATES PATENT AND TRADEMARK OFFICE

CERTIFICATE OF CORRECTION

PATENT NO. : 5,016,788

DATED : May 21, 1991

INVENTOR(S) : Eric Hanse and Gilbert Rancoule

It is certified that error appears in the above-identified patent and that said Letters Patent is hereby corrected as shown below:

Title page, after Inventors: "Rancoulle" should read --Rancoule--.

Claim 6 Line 49 Column 4 "2" should read --5--.

Signed and Sealed this

Twenty-second Day of September, 1992

*Attest:*

DOUGLAS B. COMER

*Attesting Officer*

*Acting Commissioner of Patents and Trademarks*